United States Patent [19]

Saigusa

[11] Patent Number: 4,625,466

[45] Date of Patent: Dec. 2, 1986

[54] POLISHING WHEEL

[75] Inventor: Kyuji Saigusa, Tokyo, Japan

[73] Assignee: Sankyorikagaku Kabushiki-Kaisha, Tokyo, Japan

[21] Appl. No.: 571,597

[22] Filed: Jan. 17, 1984

[30] Foreign Application Priority Data

Aug. 19, 1983 [JP] Japan ..... 58-127330[U]
Aug. 19, 1983 [JP] Japan ..... 58-127331[U]

[51] Int. Cl.[4] ..... B24D 13/00
[52] U.S. Cl. ..... 51/403; 51/207
[58] Field of Search ..... 51/207, 297, 298, 360, 51/361, 401, 403

[56] References Cited

U.S. PATENT DOCUMENTS 691,066 1/1902 Miller ..... 51/403
1,529,701 3/1925 Hewitt ..... 51/297 X
2,335,902 12/1943 Ball et al. ..... 51/403
3,731,437 5/1973 Ewell ..... 51/403 X
4,133,147 1/1979 Swift ..... 51/403 X

FOREIGN PATENT DOCUMENTS 12-13973 11/1937 Japan .
45-26309 10/1970 Japan .
51-1591 1/1976 Japan .

*Primary Examiner*—Robert P. Olszewski
*Attorney, Agent, or Firm*—John E. Reilly

[57] ABSTRACT

A polishing wheel comprises a ribbon-like polishing cloth whose outside periphery is provided with an abrasive surface, and a flexible band which is made of foamed plastic or similar material and has the same width as that of said ribbon-like polishing cloth in one embodiment; or a high-density abrasive polishing cloth which has an abrasive face at the outside periphery thereof and is fixed to an inside of said ribbon-like polishing cloth, both being spirally wound together and fixed together by using adhesive therebetween.

2 Claims, 7 Drawing Figures

POLISHING WHEEL

This invention relates to a novel and improved polishing wheel.

BACKGROUND AND FIELD OF THE INVENTION

In conventional grinding using an abrasive paper, abrasive is provided on the circumference of a rotating polishing wheel so that it is in press contact with an object to be ground or polished in order to grind or polish a planar surface of the object which is positioned in parallel to the rotating polishing wheel shaft. This mode of grinding or polishing, however, has the disadvantage of considerable consumption of abrasive; and generation of considerable heat due to continuous grinding by the abrasive surface which leads to burn-out, deterioration and deformation of the object.

SUMMARY OF THE INVENTION

It is therefore an object of the present invention to provide for a novel and improved polishing wheel to overcome the above-mentioned disadvantages.

According to the present invention, a polishing wheel, upon which a ribbon-like polishing cloth is wound spirally and fixed together by an adhesive so that an abrasive face is positioned at the external circumference thereof, is arranged in such a manner that the external circumference thereof is in tangential edge contact with an object to be polished or ground to allow powerful polishing or grinding.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 2:
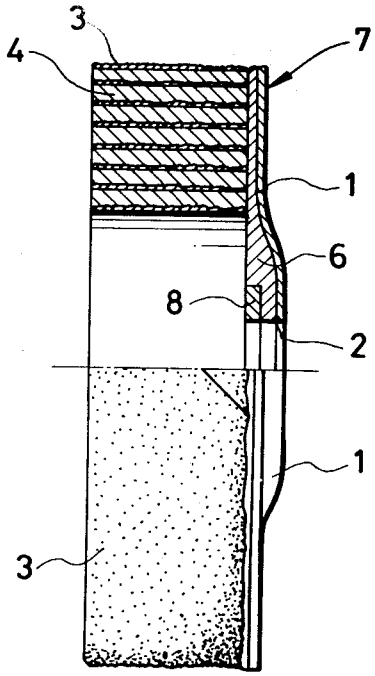
FIG. 2 is a view partially in section of said embodiment of FIG. 1.
Figure 3:
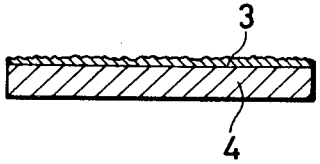
FIG. 3 is an enlarged cross-sectional view illustrating a single layer of cloth and band in the embodiment of FIG. 1.
Figure 1:
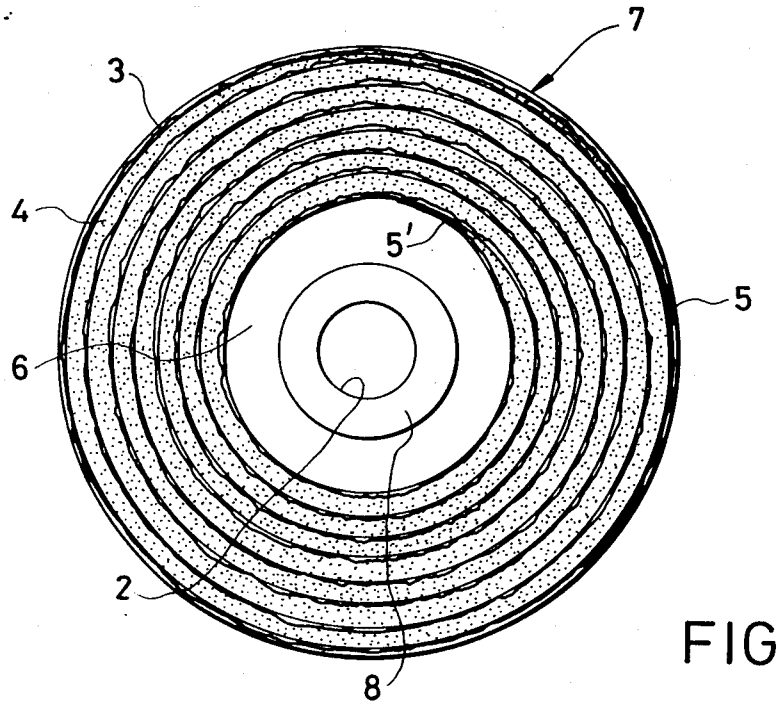
FIG. 1 is an elevational view in full of one embodiment of the invention.
Figure 5:
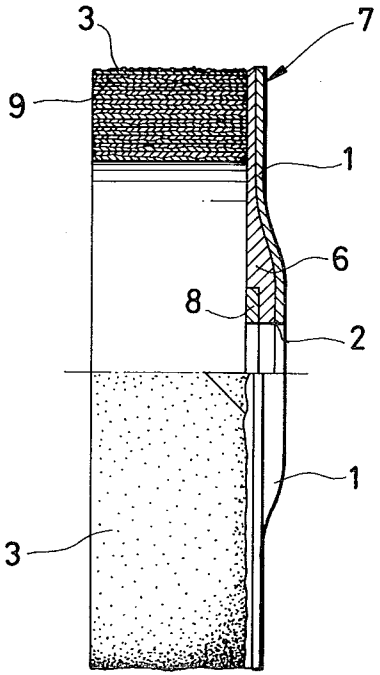
FIG. 5 is a view partially in section of said embodiment of FIG. 4.
Figure 6:
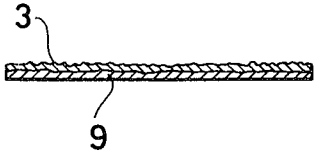
FIG. 6 is an enlarged cross-sectional view illustrating a single layer of cloth and band of said embodiment shown in FIG. 4.

Referring in more detail to the drawings, two embodiments of the present invention will be described:

First, one embodiment of the present invention shown in FIG. 1 through FIG. 3 is described. A power tool has a conventional form of driveshaft onto which is secured a backing member defined by a disk 1 made of fiber having a central shaft hole 2. A ribbon-like polishing cloth 3 is made of a synthetic resin cloth, such as, a phenol resin containing an inorganic filler which is wound spirally in a plurality of turns with an abrasive face thereof being directed outwards, the abrasive face preferably defined by abrasive particles embedded in the exposed surface of the cloth. A flexible band 4 composed of foamed plastic or similar material has the same width as that of the polishing cloth 3. A layer of adhesive designated at 5 and 5' is used to fix a start and is interposed between the inner turn of the polishing cloth 3 and an end of winding of the polishing cloth 3 and the flexible band 4, and the adhesive is applied between the turns of the cloth 3 and band 4 so as to extend continuously from the inner terminal end to the outer terminal end of the spiral.

A polishing wheel 7 comprises the above-mentioned polishing cloth 3 and flexible band 4 both being interleaved in a spiral fashion, one edge of which is fixed to one side of the fiber disk 1 by a bonding agent 6 and a washer 8.

Figure 4:
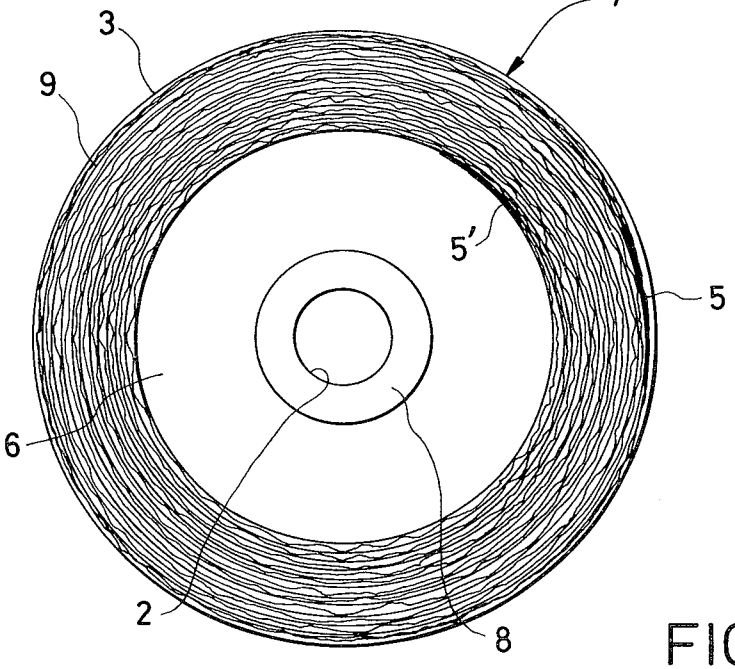
FIG. 4 is an elevational view in full of another embodiment of the invention.

Secondly, another embodiment of the present invention shown in FIG. 4 is described. A backing member or disk 1 is made of fiber and has a shaft hole 2. A ribbon-like polishing cloth 3 is made of a resin cloth, and is wound spirally in a plurality of turns with an outer facing abrasive surface thereof being directed outwards. A high-density abrasive polishing cloth 9 which is of mesh structure is in contact with an inside of the polishing cloth 3, and wound together therewith so that the abrasive face is directed outwards. Extra adhesive at 5 and 5' is used to fix a start and end of winding of the polishing cloth 3 and the high-density abrasive polishing cloth 9 as well as being applied along the confronting sufaces therebetween.

Figure 7:
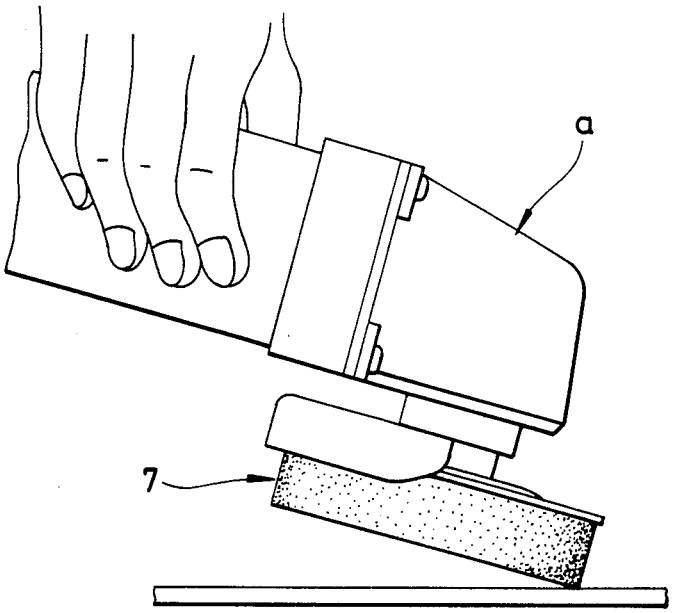
FIG. 7 is an elevational view illustrating the mounting of one of said embodiments of the present invention on a conventional grinder.

A polishing wheel 7 comprises the above-mentioned polishing cloth 3 and flexible band 4 both being wound spirally, one side of which is fixed to one side of the fiber disk 1 by using an adhesive 6 and a washer 8. The polishing wheel 7 is attached to an electrically driven sander for a polishing or grinding operation as illustrated in FIG. 7. As described earlier, the polishing wheel is in tangential edge contact with an object to be polished or ground since an abrasive face thereof is provided at an external periphery of the spirally wound polishing cloth. Therefore, full pressure can be concentrated along a tangential edge contact line with the object to be polished or ground for powerful and efficient grinding because of increased grinding pressure per unit of contact area. As the outer layer wears away along the edge, it will expose the next adjacent layer edge for polishing.

In the first embodiment, ordinary polishing is achieved with excellent effects, and the polishing wheel can be prevented from clogging with grinding particles by polishing along the edges. The flexible band lends an air cooling effect to the grinding operation to eliminate any trace of burn-out; and smooth grinding can always be achieved since the polishing wheel is in close and flexible contact with the object to give high cushion effect. In this relation, grinding operations at welds and removal of rust from steel plates can be done in a short time.

In the second embodiment, by using two polishing cloths with different properties spirally wound together in two layers, the polishing wheel has high resistance to wear and excellent grinding ability. This form offers great economy as high grinding ability can be maintained for a long time, and allows smooth finishing in a short time as it is not only a flexible double-cloth structure but in close contact with the object without exhibiting a partial flapping phenomenon; that is, the layers tending to separate or tear off. Thus, practical effect of these embodiments of the present invention is significant.

It is therefore to be understood that various modifications and changes may be made in the specific construction and arrangement of parts comprising the present invention without departing from the spirit and scope thereof as defined by the appended claims.

I claim:

1. A polishing wheel for attachment to a disk mounted for rotation on a drive shaft of a power tool, said polishing wheel comprising: a plurality of spiral turns of a flexible, ribbon-like polishing cloth, said cloth provided with an outwardly facing abrasive surface, a plurality of spiral turns of a ribbon-like flexible band of a width corresponding to said cloth, said band interleaved between said turns of said polishing cloth and coextensive therewith, said polishing cloth defining the outermost of said interleaved layers, adhesive securing means securing said spiral turns of said cloth and said flexible band together along their substantial length; and means securing side edges of said cloth and said band to a surface of said disk whereby an opposite side edge of said cloth is exposed and movable into tangential edge contact with an object to be polished.

2. In a motor-driven polisher wherein a disk is mounted for rotation on a drive shaft of said polisher, the improvement comprising:

a polishing wheel including a plurality of spiral turns of a first flexible, ribbon-like polishing cloth having an outer peripheral surface, a plurality of spiral turns of a second high density, flexible polishing cloth extending between said spiral turns of said first polishing cloth and coextensive therewith, each of said polishing cloths having outer abrasive faces, adhesive means adhering said spiral turns of said first and second polishing cloths together, and means securing one side of said polishing wheel to said disk whereby the opposite side of said polishing wheel is exposed at least along said outer peripheral surface and movable into tangential edge contact with an object to be polished.

* * * * *